US012173435B2

(12) United States Patent
Watanabe et al.

(10) Patent No.: US 12,173,435 B2
(45) Date of Patent: Dec. 24, 2024

(54) CONTROLLING DEVICE AND METHOD FOR SEWING MACHINE, AND SEWING MACHINE

(71) Applicant: TISM CO., LTD., Kasugai (JP)

(72) Inventors: Hiroshi Watanabe, Kasugai (JP); Takuya Okamoto, Kasugai (JP)

(73) Assignee: TISM CO., LTD., Kasugai (JP)

( * ) Notice: Subject to any disclaimer, the term of this patent is extended or adjusted under 35 U.S.C. 154(b) by 0 days.

(21) Appl. No.: 18/041,959

(22) PCT Filed: Sep. 10, 2021

(86) PCT No.: PCT/JP2021/033369

§ 371 (c)(1),
(2) Date: Feb. 16, 2023

(87) PCT Pub. No.: WO2022/065083

PCT Pub. Date: Mar. 31, 2022

(65) Prior Publication Data

US 2024/0026584 A1 Jan. 25, 2024

(30) Foreign Application Priority Data

Sep. 24, 2020 (JP) ..... 2020-159959

(51) Int. Cl.
*D05B 19/10* (2006.01)
*D05B 19/14* (2006.01)
(Continued)

(52) U.S. Cl.
CPC ..... *D05B 19/10* (2013.01); *D05B 19/14* (2013.01); *D05B 35/06* (2013.01); *D05C 7/08* (2013.01)

(58) Field of Classification Search
CPC ..... D05B 35/06; D05B 19/10; D05B 19/12; D05B 19/14; D05C 7/08
See application file for complete search history.

(56) References Cited

U.S. PATENT DOCUMENTS 6,957,615 B1 * 10/2005 Landoni ..... D05C 7/08 112/117
2007/0199490 A1 8/2007 Suzuki
2008/0302287 A1 12/2008 Tajima et al.

FOREIGN PATENT DOCUMENTS

JP H0693943 B2 11/1994
JP 2007222484 A 9/2007
(Continued)

OTHER PUBLICATIONS

International Search Report issued in Intl. Appln. No. PCT/JP2021/033369 mailed Nov. 22, 2021. English translation provided.
(Continued)

*Primary Examiner* — Nathan E Durham
(74) *Attorney, Agent, or Firm* — ROSSI, KIMMS & McDOWELL LLP

(57) ABSTRACT

The present invention aims to speed up of processing necessary at the time of switching between different sewing operation modes. Sewing data supply means supplies sewing data having mixed therein data indicative of different sewing operation modes. The sewing machine sews, based on the sewing data, a string-shaped material to a workpiece with different sewing operation modes mixed. A control device for the sewing machine includes a quick shift process means that controls, at a boundary between the different sewing operation modes and depending on a difference between the sewing operation modes immediately preceding and succeeding the boundary, whether to execute a process for shifting to the succeeding sewing operation mode while keeping a main shaft of the sewing machine rotating (rapid process) or to execute the process for shifting to the succeeding sewing operation mode after temporarily stopping the rotation of the main shaft (normal shift process).

11 Claims, 5 Drawing Sheets

(51) Int. Cl.
*D05B 35/06* (2006.01)
*D05C 7/08* (2006.01)

(56) References Cited

FOREIGN PATENT DOCUMENTS

| | | | |
|---|---|---|---|
| JP | 2007229013 | A | 9/2007 |
| JP | 2008302070 | A | 12/2008 |

OTHER PUBLICATIONS

Written Opinion issued in Intl. Appln. No. PCT/JP2021/033369 mailed Nov. 22, 2021.

* cited by examiner

FIG. 5

| STEP | PROGRAM CONTROL DATA (DETAILS OF SEWING OPERATION MODE) | | | |
|---|---|---|---|---|
| | STITCHING TECHNIQUE | NIPPLE HEIGHT | NHIPPLE'S BOTTOM DEAD POINT | QUICK SHIFT PROCESS |
| 1 | N | 6 | 0.5 | R |
| 2 | Z1 | 8 | 1 | R |
| 3 | Z4 | 4 | 2 | — |
| 4 | Z4 | 6 | 0.5 | — |
| 5 | T | 1 | 0.1 | — |

FIG. 6

| | | STITCHING TECHNIQUE IN SUCCEEDING STEP | | | | | | | | | | |
|---|---|---|---|---|---|---|---|---|---|---|---|---|
| | | N | T | Z1 | Z2 | Z3 | Z4 | Z5 | Z6 | C | H | F |
| STITCHING TECHNIQUE IN PRECEDING STEP | N | ○ | × | ○ | ○ | ○ | ○ | ○ | ○ | × | × | × |
| | T | × | ○ | × | × | × | × | × | × | × | × | × |
| | Z1 | ○ | × | ○ | ○ | ○ | ○ | ○ | ○ | × | × | × |
| | Z2 | ○ | × | ○ | ○ | ○ | ○ | ○ | ○ | × | × | × |
| | Z3 | ○ | × | ○ | ○ | ○ | ○ | ○ | ○ | × | × | × |
| | Z4 | ○ | × | ○ | ○ | ○ | ○ | ○ | ○ | × | × | × |
| | Z5 | ○ | × | ○ | ○ | ○ | ○ | ○ | ○ | × | × | × |
| | Z6 | ○ | × | ○ | ○ | ○ | ○ | ○ | ○ | × | × | × |
| | C | × | × | × | × | × | × | × | × | ○ | × | × |
| | H | × | × | × | × | × | × | × | × | × | ○ | × |
| | F | × | × | × | × | × | × | × | × | × | × | ○ |

○: QUICK SHIFT PROCESS EXECUTABLE

×: QUICK SHIFT PROCESS NON-EXECUTABLE (MAIN SHAFT STOPPED)

CONTROLLING DEVICE AND METHOD FOR SEWING MACHINE, AND SEWING MACHINE

TECHNICAL FIELD

The present invention relates generally to a sewing machine capable of sewing a string-shaped material, such as a tape or a cord, to a sewing workpiece, such as a cloth or fabric, and particularly to a controlling device and a controlling method for such a type of sewing machine. More particularly, the present invention relates to executing a quick shift process for speeding up processing necessary at the time of switching between different sewing operation modes in a sewing machine capable of performing such different sewing operation modes in combination.

BACKGROUND

Heretofore, there has been known an embroidery sewing machine (lock-stitching handle embroidery machine) capable of sewing a string-shaped material, such as a tape or a cord, to a sewing workpiece (or base fabric) by feeding the string-shaped material to a needle entry position. Such an embroidery sewing machine includes: a needle bar having a sewing needle attached to its lower end portion and drivable to move vertically or up and down; a presser foot (or nipple) drivable to move in the up-down direction at predetermined timing relative to the up-down movement of the needle bar; and a rotation member mounted concentrically with the needle bar and rotatable about the axis of the needle bar. The embroidery sewing machine arranged in this manner can deal with a variety of materials and stitching methods or techniques by replacing an attachment, attached to the rotation member, with another one. Further, the up-and-down movement of the presser foot (or nipple) is controlled by a motor so that a stroke length and a bottom dead point of the presser foot can be changed in accordance with a thickness of the sewing workpiece, a type of the string-shaped material, and the like.

As an example, a sewing machine described in Patent Literature 1 includes a zigzag stitching attachment (or guide section) capable of sewing a string-shaped material, such as a tape or a cord, to a sewing workpiece by feeding the string-shaped material while swinging the string-shaped material in a zigzag fashion. This sewing machine also includes a guide lever for guiding the string-shaped material to an entry position of a sewing needle, and the guide lever is pivotably mounted to the rotation member via a lever pin. In embroidering, not only an embroidery frame is moved on the basis of embroidery data corresponding to a desired embroidery pattern, but also a sewing progressing direction relative to the sewing workpiece is calculated in order to control a direction of the rotation member in such a manner that the lever pin is always positioned ahead in the sewing progressing direction and thus a direction of the string-shaped material is controlled in accordance with the desired embroidery pattern. At the same time, the guide lever is caused to reciprocatingly pivot about the lever pin in synchronism with the movements of the needle bar and the nipple to thereby cause the string-shaped material to swing in a zigzag fashion (namely, swing leftward and rightward relative to the sewing progressing direction). In this manner, the string-shaped material is fed to the needle entry position while being caused to zigzag-swing in accordance with the desired sewing pattern (embroidery pattern) and thus the string-shaped material is sewn to the sewing workpiece with zigzag stitches commonly called "zigzag stitching".

Further, a sewing machine described in Patent Literature 2 includes a tape stitching guide section for guiding a flat and wide tape (string-shaped material) to the needle entry position. In this sewing machine, the tape (string-shaped material) wound on a bobbin is passed through the guide section to be fed to the needle entry position, and then the tape is sewn to the sewing workpiece by linear stitches commonly called "tape stitching". Generally, both a zigzag stitching attachment (or guide section) and a tape stitching attachment (or guide section) can be mounted to one sewing machine, in which case an ornamental pattern can be formed by combining the zigzag stitching and the tape sewing.

In general, the embroidery sewing machine can automatically perform an embroidery sewing operation on the basis of embroidery data stored in an internal storage unit of the sewing machine and can variably set a particular way of sewing or stitching (sewing operation mode) in the embroidery sewing operation on the basis of program control data (namely, so called Pro-con Data) stored in association with the embroidery data (see, for example, Patent Literature 3 set forth below). The embroidery data include frame movement data (X and Y data) that are indicative of stitch-by-stitch movement amounts of the embroidery frame and control codes that function as control signals in the sewing operation. The control codes include a variety of codes related to the sewing operation, such as a color change code, a jump code, a thread cut code, and a stop code.

The above-mentioned program control data are data (Pro-con Data) that set and/or control ways of sewing (namely, sewing operation modes) in a sewing operation composed of a plurality of stitches. Each of the ways of sewing (sewing operation modes) can be set and/or controlled by various factors, such as a stitching technique, a zigzag pattern, a height and a bottom dead point of the nipple (nipple stroke), and the number of rotations of a main shaft of the sewing machine. The factors of the stitching technique are factors that determine specific stitching techniques, such as flat stitching, tape stitching, zigzag stitching, rolled stitching, pleat stitching, and frill stitching. The factors of the zigzag pattern are factors that determine a pattern of zigzag swinging (for example, select any one of a plurality of zigzag swinging patterns) and that determine a zigzag swinging width. The factor of the nipple stroke is a factor that variably determines a stroke length of the up-and-down movement of the nipple (or presser foot), the "height" of the nipple is a height of the top dead point in the nipple stroke, and the "bottom dead point" is a height of the bottom dead point in the nipple stroke.

Furthermore, the aforementioned control codes include a predetermined control code (step switch code or mode-switching control code) that instructs timing for switching the way of sewing (namely, sewing operation mode) to another or next one. According to the conventionally known technique, at timing when such a predetermined control code (step switch code or mode-switching control code) is given, the rotation of the main shaft of the sewing machine is temporarily stopped, and then movement control, initial setting of related mechanisms (attachment or guide section, and others), and the like are performed automatically or manually so as to adapt to the next way of sewing (namely, next sewing operation mode). For example, when the technique for stitching the string-shaped material is to be switched from the tape stitching to the zigzag stitching or from the zigzag stitching to the tape stitching, there is a need to change some arrangements, such as replacing the attachment (guide section) for guiding the string-shaped material to the needle entry position with another attachment (guide section) suited for the switched-to zigzag stitching or tape stitching and setting the string-shaped material on the other attachment (guide section), and thus it is necessary to temporarily stop the rotation of the main shaft.

PRIOR ART LITERATURE

Patent Literature

Patent Literature 1: Japanese Patent Application Laid-open Publication No. 2008-302070

Patent Literature 2: Japanese Patent Application Laid-open Publication No. 2007-222484

Patent Literature 3: Japanese Patent Publication No. H6-93943

SUMMARY

In view of the foregoing prior art problems, it is one of the objects of the present invention to provide a controlling device and a controlling method for a sewing machine which, where a string-shaped material is to be sewn to a workpiece in different sewing operation modes, enable speed up of processing necessary at the time of switching between the sewing operation modes, and a sewing machine provided with such a controlling device.

A controlling device for a sewing machine according to the present invention is applied to a sewing machine that is configured to sew a string-shaped material to a workpiece on the basis of pre-programmed sewing data, and the controlling device is configured to control such a sewing operation of the sewing machine on the basis of the sewing data. In particular, the controlling device for a sewing machine according to the present invention is characterized by including: sewing data supply means that supplies the sewing data having a plurality of pieces of operation mode information, indicative of different sewing operation modes, mixed therein; and quick shift process means that controls, at a boundary between the different sewing operation modes and depending on a difference between the sewing operation modes immediately preceding and succeeding the boundary, whether to execute a process for shifting to the succeeding sewing operation mode while keeping a main shaft of the sewing machine rotating or to execute the process for shifting to the succeeding sewing operation mode after temporarily stopping the rotation of the main shaft. The present invention can be implemented also as a sewing machine provided with such a controlling device.

According to the present invention, when switching between the sewing operation modes, it is possible to perform control such that depending on the difference between the sewing operation modes immediately preceding and succeeding the switching, the sewing operation shifts to the succeeding sewing operation mode while keeping the main shaft rotating, without necessarily having to temporarily stop the rotation of the main shaft. Thus, it is possible to efficiently selectively perform the process for shifting to the succeeding sewing operation mode while keeping the main shaft of the sewing machine rotating (namely, perform a quick shift process or rapid process) or the process for shifting to the succeeding sewing operation mode after temporarily stopping the rotation of the main shaft (namely, perform a normal shift process). With such arrangements, as a whole, the present invention can speed up processing necessary when switching between the sewing operation modes.

BRIEF DESCRIPTION OF DRAWINGS

FIG. 5 is a table illustrating example settings of program control data;

FIG. 6 is a table of examples of a determination as to whether or not a quick shift process can be executed made depending on a difference between sewing operation modes (particularly, "stitching techniques") before and after sewing operation mode switching;

DETAILED DESCRIPTION

Figure 1:
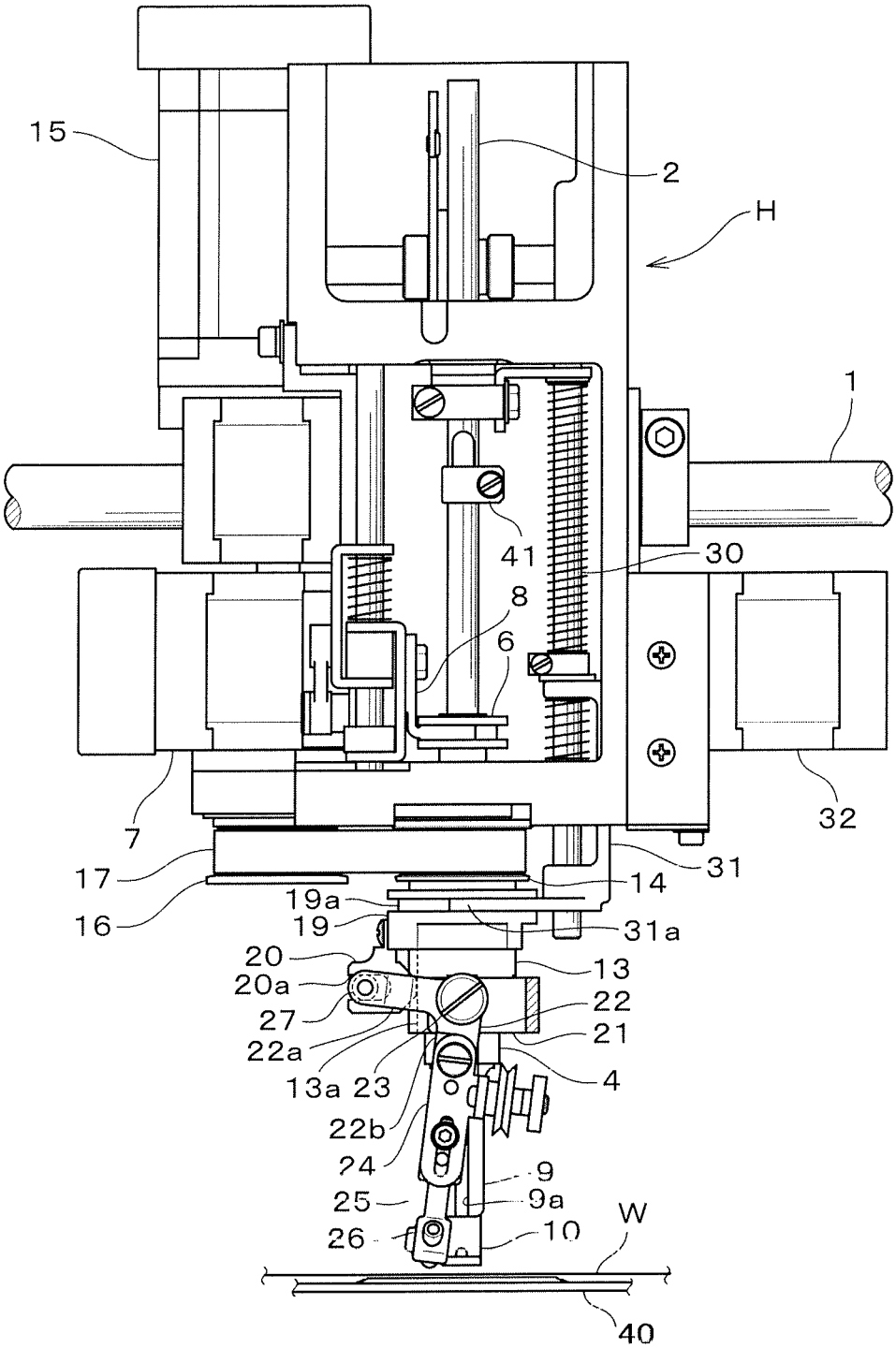
FIG. 1 is a front view illustrating an embodiment of a sewing machine to which is applied a controlling device of the present invention and particularly illustrating one machine head provided in the sewing machine.
Figure 2:
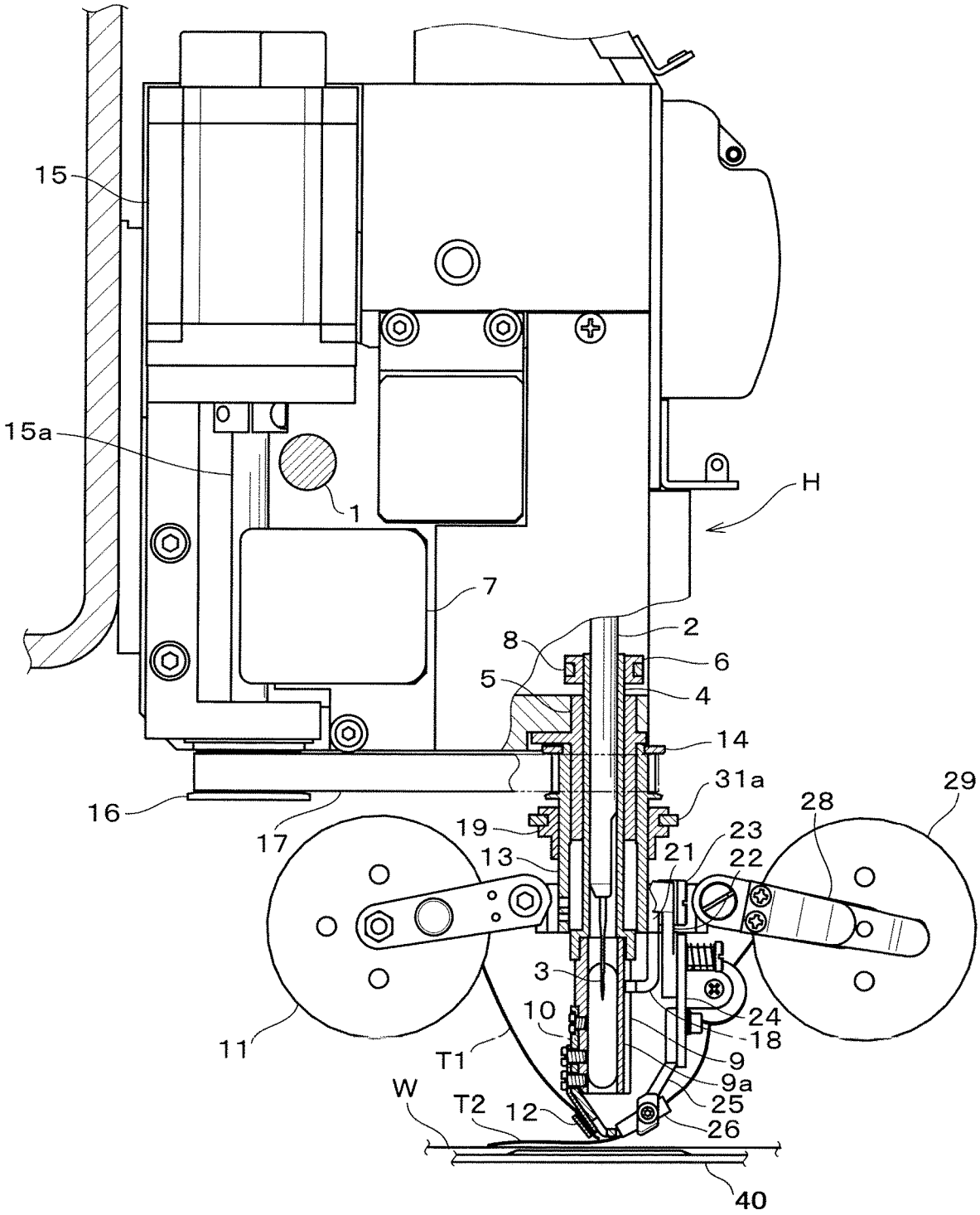
FIG. 2 is a partly broken-away side view of the machine head illustrated in FIG. 1.

FIG. 1 is a front view illustrating an embodiment of a sewing machine to which is applied a controlling device of the present invention and more particularly illustrating one machine head H provided in the sewing machine, and FIG. 2 is a partly broken-away side view of the machine head H illustrated in FIG. 1. A plurality of such machine heads H, rather than just one machine head H, may be provided in the inventive sewing machine. A needle bar 2 is provided on the machine head H in such a manner that the axis of the needle bar 2 extends in an up-down direction (vertical direction). The needle bar 2 is driven to reciprocatingly move in the up-down direction by rotation of a main shaft 1 of the sewing machine. A sewing needle 3 is attached to a lower end portion of the needle bar 2. A support cylinder 4 is mounted around the outer periphery of the needle bar 2, and this support cylinder 4 is capable of not only moving up and down relative to the needle bar 2 but also rotating about the axis of the needle bar 2 while being guided along the inner peripheral surface of a fixed sleeve 5 fixed to a lower portion of the machine head H. Further, an engaging ring 6 is fixed to the outer periphery of an upper end portion of the support cylinder 4, and a drive arm 8 movable in the up-down direction by being driven by a motor 7 is held in engagement with the engaging ring 6.

A presser foot support member 9 is fixed to the lower end of the support cylinder 4. The presser foot support member 9 has a lower end portion formed in a bifurcated shape to provide two leg portions, and an elongated key groove **9*a* extending in the up-right direction is formed in an outer side surface of one of the leg portions of the presser foot support member 9. A presser foot (or nipple) 10 is fixed to the other leg portion of the support member 9. As illustrated in FIG. 2, a guide 12 for guiding a string-shaped material T1, paid out from a bobbin 11, to an entry position of the sewing needle 3 is fixed to the presser foot 10. A rotation cylinder 13 is mounted on the outer periphery of the fixed sleeve 5. The rotation cylinder 13 is mounted around and concentrically with the needle bar 2 and only rotatable about the axis of the needle bar 2. A timing pulley section 14 is formed on the outer periphery of an upper end portion of the rotation cylinder 13, and a timing belt 17 is wound on and extends between the timing pulley section 14 and a drive pulley 16 fixed to a rotation shaft 15***a* of a direction controlling motor 15. Thus, as the direction controlling motor 15 is driven to rotate the drive pulley 16, the rotation cylinder 13 is rotated via the timing belt 17 and the timing pulley section 14. Further, a key member 18 engaging with the key groove 9*a* of the presser foot support member 9 is fixed to a lower end portion of the rotation cylinder 13. With such arrangements, the presser foot support member 9 not only moves up and down as the support cylinder 4 moves up and down but also rotates about the axis of the needle bar 2 as the rotation cylinder 13 rotates. A combination of the bobbin 11 having the string-shaped material T1 wound thereon, the guide 12 for guiding the string-shaped material T1 to the entry position of the sewing needle 3, the direction controlling motor 15 related to the guide 12, the rotation cylinder 13, and the like functions as a guide section that guides the string-shaped material T1 to a sewing position for so-called "tape stitching".

Further, an interlocking member 19 is fitted over the outer periphery of the rotation cylinder 13 in such a manner that the interlocking member 19 is not only movable up and down but also rotatable. Namely, the interlocking member 19 is movable up and down and rotatable independently of the rotation cylinder 13. A connection piece 20 is fixed to the interlocking member 19 and held in engagement in an engaging groove 13*a* formed in the outer periphery of the rotation cylinder 13. Thus, the interlocking member 19 is rotatable together with the rotation cylinder 13 as the rotation cylinder 13 rotates. Further, a guide lever 22 is mounted to the rotation cylinder 13 via a bracket 21. The guide lever 22 is mounted in such a manner that the lever 22 is swingable, about a lever pin 23 mounted to an outer side surface of the bracket 22, leftward and rightward of the axis of the needle bar 2 relative to the rotation cylinder 13. The guide lever 22 has one arm portion 22*a* extending laterally from a portion thereof adjoining the lever pin 23 and another arm portion 22*b* extending downward from the portion adjoining the lever pin 23. A guide member 25 is connected to the lower end of the arm portion 22*b* via a connection member 24. A guide tube 26 for feeding another string-shaped material T2 to the entry position of the sewing needle 3 is mounted to the lower end of the guide member 25. A roller 27 is mounted to a distal end portion of the laterally extending arm portion 22*a*, and this roller 27 is held in engagement in a linking groove 20*a* of the connection piece 20. As illustrated in FIG. 2, a bobbin bracket 28 is fixed to the outer periphery of the rotation cylinder 13, and another bobbin 29 having the string-shaped material T2 wound thereon is rotatably supported on the bobbin bracket 28. Note that illustration of the bobbins 11 and 29 is omitted in FIG. 1 for convenience.

As illustrated in FIG. 1, a guide shaft 30 is disposed adjoining the needle bar 2 in such a manner that the axis of the shaft 30 extends in the up-down direction. A lifting and lowering member 31 is mounted on the guide shaft 30. The lifting and lowering member 31 is movable up and down along the axis of the guide shaft 30 while being guided by the shaft 30, by rotational driving force of a zigzag swinging motor 32 being transmitted to the member 31 via a not-illustrated drive transmission mechanism. The lifting and lowering member 31 has a fork portion 31*a* projecting substantially horizontally toward the needle bar 2, and this fork portion 31*a* is held in engagement in a groove portion 19*a* formed in the outer periphery of the interlocking member 19. Thus, as the interlocking member 19 and the connection piece 20 move up and down in response to the up-and-down movement of the lifting and lowering member 31, the up-and-down movement of the connection piece 20 is converted into swinging movement of the guide lever 22 via the linking groove 20*a* and the roller 27. Thus, the guide tube 26 fixed to a lower end portion of the guide lever 22 is reciprocatingly swung (namely, zigzag-swung) about the lever pin (swing shaft) 23 leftward and rightward with respect to a sewing progressing direction through an operation of a swing mechanism composed of various elements from the zigzag swinging motor 32 to the guide member 25. A combination of the bobbin 29 having the string-shaped material T2 wound thereon, the guide member 25 and the guide tube 26 that guide the string-shaped material T2 to the entry position of the sewing needle 3, the direction controlling motor 15 related to the guide member 25 and the guide tube 26, the rotation cylinder 13, and the like functions as a guide section that guides the string-shaped material T2 to the sewing position (needle entry position) for so-called "zigzag stitching". Further, a combination of the zigzag swinging motor 32, the guide lever 22, and the like related to such a guide section functions as a zigzag swinging mechanism for zigzag-swinging the string-shaped material T2, guided by the guide section (guide member 25, the guide tube 26, and the like), leftward and rightward.

Namely, in the illustrated embodiment, two different types of guide sections (namely, the guide section for "tape stitching" and the guide section for "zigzag stitching") are provided. However, the present invention is not so limited, and only either one of the aforementioned two guide sections may be provided. Alternatively, another suitable type of guide section may be provided. Note, however, that these different types of guide sections are never caused to operate concurrently and only one of the aforementioned types of guide sections is selectively caused to operate during a given time period. For example, FIG. 2 illustrates a state where the string-shaped material T2 is guided to the entry position of the sewing needle 3 while the other string-shaped material T1 is kept still after being cut just before the entry position of the sewing needle 3, namely, without reaching the needle entry position. Note that as known, for example, from Patent Literature 1 set forth above, the "zigzag stitching" guide member 25 is moved to a predetermined retreat position when the sewing of the string-shaped material T2 is not to be executed. When the sewing of the string-shaped material T2 is to be started, the "zigzag stitching" guide member 25 having so far been held in the retreat position is moved from the retreat position to its operating position. Although the movement of the guide member 25 between the retreat position and the operating position may be executed in response to a manual operation as described in Patent Literature 1, the movement of the guide member 25 may be automatically switched between the retreat position and the operating position as necessary.

A needle plate 40 is disposed on the upper surface of a rotary hook base (not illustrated in the drawings), and a lower thread rotary hook (not illustrated) is provided underneath the needle plate 40. In the sewing machine of FIG. 1 that is, for example, an embroidery sewing machine, an embroidery frame (not illustrated in the drawings) holding a sewing workpiece (namely, base fabric or workpiece) W is driven two dimensionally in synchronism with a sewing operation in accordance with a desired sewing pattern, and thus the sewing workpiece (base fabric) W is moved relative to the machine head H, as in the conventionally known counterpart. To sew the string-shaped material T1 or T2 to the sewing workpiece (base fabric) W in accordance with the desired sewing pattern, the driving of the motor 15 is controlled in accordance with the sewing progressing direction, the rotation cylinder 13 is rotated in response to the driving of the motor 15, and the guide section 12 or the guide member 25 (guide tube 26) is controlled to make single pivoting or swinging movement either leftward or rightward through a given angle around the needle bar 2 in such a manner that the distal end of the guide section 12 or the distal end of the guide member 25 is always oriented toward the needle bar 2.

A needle bar jump function for temporarily stopping the reciprocating movement of the needle bar 2 while keeping the main shaft 1 rotating is known in the art. The machine head H in the present embodiment, too, includes a needle bar jump mechanism for executing such a needle bar jump function. As illustrated in FIG. 1, a needle bar holder 41 is connected to the needle bar 2, and the rotating movement of the main shaft 1 is transmitted, via a not-illustrated movement transmission mechanism, to the needle bar holder 41 to cause up-and-down movement of the needle bar holder 41. In this manner, the needle bar 2 is reciprocatingly moved up and down in synchronism with the rotation of the main shaft 1. The needle bar jump mechanism includes a needle bar jump motor (not illustrated in the drawings). Normally, the needle bar jump motor is kept in a non-operating state, in which the movement transmission mechanism and the needle bar holder 41 are held in engagement with each other in such a manner that the rotating movement of the main shaft 1 is transmitted via the movement transmission mechanism to cause the up-and-down movement of the needle bar holder 41. Once the needle bar jump motor is switched to an operating state, the engagement between the movement transmission mechanism and the needle bar holder 41 is cancelled, so that the needle bar holder 41 stays at a predetermined position although the main shaft 1 is kept rotating. In this manner, the reciprocating movement of the needle bar 2 is temporarily stopped to cause a needle bar jump state.

Materials, shapes, and the like of the string-shaped materials T1 and T2 are determined as appropriate in accordance with an intended purpose of a sewn product that is to be made by use of the inventive sewing machine. For example, in a case where an ornamental string-shaped material is to be sewn to the sewing workpiece, a tape or a cord of a color, a size and an outer shape (flat or rounded outer shape) fitting the ornamental purpose may be used as the string-shaped material. Alternatively, in a case where a tow (long fiber bundle) that functions as reinforcing fibers for preform molding of a fiber-reinforced composite material is to be sewn to the sewing workpiece, such a tow that functions as reinforcing fibers is used as the string-shaped material.

Figure 3:
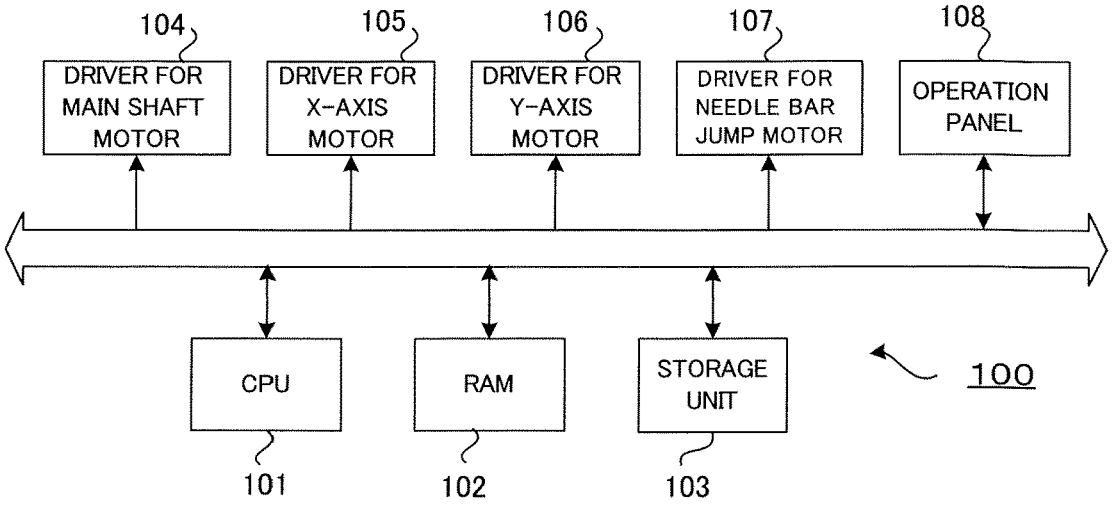
FIG. 3 is a block diagram illustrating a general configuration of an electronic controlling device applied to the embodiment of the inventive sewing machine.

FIG. 3 is a block diagram illustrating a general configuration of an electronic controlling device 100 applied to the embodiment of the inventive sewing machine. The controlling device 100 includes: a CPU (Central Processing Unit) 101 that controls various processing and driving operations of the sewing machine; a RAM (Random Access Memory) 102 having a working area of the CPU 101; and a storage unit 103 (that may be, for example, in the form of a read-only memory or ROM or a read/write memory, such as a flash memory or a hard disk) having stored therein in a non-volatile manner pre-programmed embroidery data (sewing data) of one or more patterns, program control data related to the embroidery data (sewing data), and various processing programs. Furthermore, the controlling device 100 includes a driver 104 for a main shaft motor for rotating the main shaft 1, drivers 105 and 106 for X-axis and Y-axis motors for moving the embroidery frame in X and Y directions, respectively, and a driver 107 for the aforementioned needle bar jump motor; each of the aforementioned motors is connected to a respective one of the drivers. The controlling device 100 further includes an operation panel 108 as a user input/output interface. The operation panel 108 is composed of, for example, a touch panel that displays images and receives user's input operations, and various setting and controlling screens are displayed on this touch panel. The user can perform various operations and settings by, for example, touching operation images and the like displayed on the screens of the touch panel.

The embroidery data (sewing data) stored in the storage unit 103 include frame movement data (X and Y data) indicative of stitch-by-stitch movement amounts of the embroidery frame, and control codes that function as control signals in the sewing operation. The control codes include various sewing-operation-related control codes, such as a color change code (or step switch code), a jump code, a thread cut code, and a stop code. Although the color change code is essentially a code that instructs a thread color change, the color change code is used in the present embodiment also as a step switch code that instructs switching from one sewing step to another step. In the present embodiment, such a step switch code (or color change code) is inserted in the embroidery data (sewing data) at a position where a way of sewing (namely, sewing operation mode) in one continuous sewing operation composed of a plurality of stitches is to be switched to another, namely, at a boundary between different sewing operation modes. Because the "step switch code" is a control code that instructs switching from one sewing operation mode to another, it can also be referred to as "mode-switching control code". In a case where the embroidery data (sewing data) of one embroidery pattern have a plurality of pieces of operation mode information, indicative of a plurality of different sewing operation modes, mixed therein, the step switch code (or mode-switching control code) is inserted in the embroidery data (sewing data) at each boundary between the different sewing operation modes. In the present embodiment, the storage unit 103 functions as sewing data supply means that supplies embroidery data (sewing data) having a plurality of pieces of operation mode information, indicative of different sewing operation modes, mixed therein.

The program control data are data that set and/or control a way of sewing (sewing operation mode) per sewing part or zone demarcated by the above-mentioned step switch code. The way of sewing (sewing operation mode) can be set and/or controlled by various factors, such as a stitching method or technique, a zigzag pattern, a height and a bottom dead point of the nipple (nipple stroke), and the number of rotations of the main shaft. The factor of the stitching technique is a factor that sets a specific stitching technique, such as flat stitching, tape stitching, zigzag stitching, rolled stitching, pleat stitching, or frill stitching. The factor of the zigzag pattern is not only a factor that sets a pattern of zigzag swinging (for example, selects any one of a plurality of patterns of zigzag swinging) at the time of the zigzag stitching but also a factor that sets a swinging width at the time of the zigzag stitching. The factor of the nipple stroke is a factor that variably sets an up-and-down movement stroke length of the nipple (or presser foot), the "height" of the nipple means a height of the top dead point in the nipple stroke, and the "bottom dead point" means a height of the bottom dead point in the nipple stroke. The factor of the number of rotations of the main shaft is a factor that variably sets the number of rotations of the main shaft. The program control data may be prestored in the storage unit 103 in association with the embroidery data (sewing data) corresponding to individual embroidery patterns. Alternatively, desired program control data may be set by the user by use of the operation panel 108 and the like in association with embroidery data (sewing data) of desired embroidery patterns and then stored into the storage unit 103 (or RAM 102).

As in the conventionally known sewing machines, the controlling device 100 controls the sewing operation, on the basis of the embroidery data (sewing data) for making the user-desired embroidery patterns and the related program control data stored in the storage unit 103, by causing the CPU 101 to execute the processing programs stored in the storage unit 103. What is particularly notable with respect to the present embodiment is that a program module for executing a function of quick shift process means (or rapid process means) is included in the processing programs to be executed by the controlling device 100. The quick shift process (or rapid process) in the present embodiment is a function intended to prevent the main shaft from stopping its rotation between the steps due to the step switch code of the embroidery data and thereby promote sewing or manufacturing efficiency, by setting, between each pair of the adjoining steps (namely, at each boundary between the different sewing operation modes) in the program control data and depending on a difference between the sewing operation modes preceding and succeeding the boundary, whether to shift to the succeeding or next sewing operation mode while keeping the main shaft rotating or to shift to the next sewing operation mode after temporarily stopping the rotation of the main shaft and then controlling the sewing operation in accordance with that setting. To execute such a quick shift process, the quick shift process means in the present embodiment is configured to control, at each boundary between the different sewing operation modes and depending on a difference between the sewing operation modes immediately preceding and succeeding the boundary, whether to execute a process for shifting to the succeeding or next sewing operation mode while keeping the main shaft rotating (quick shift process) or to execute the process for shifting to the next sewing operation mode after temporarily stopping the rotation of the main shaft (normal shift process). When the process for shifting to the next sewing operation mode while keeping the main shaft rotating, namely, without temporarily stopping the rotation of the main shaft (namely, quick shift process) is performed, it is possible to relatively increase the processing speed and thus achieve speed-up of the sewing operation as a whole.

Figure 4:
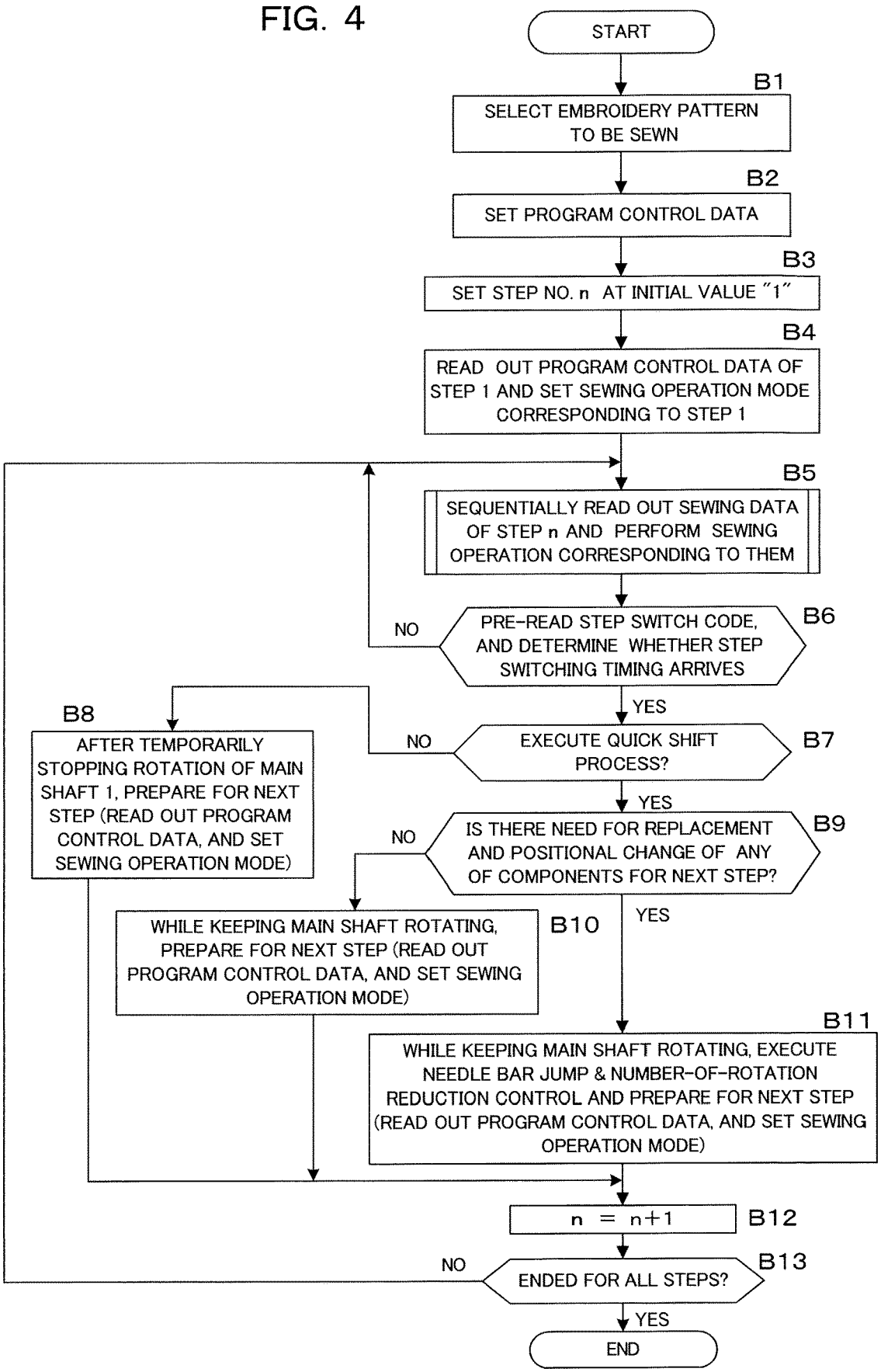
FIG. 4 is a flow chart illustrating an example of a processing program that is executed by a CPU of the controlling device.

FIG. 4 is a flow chart illustrating an example of the processing program to be executed by the CPU 101. First, the CPU 101 causes the user to select a desired embroidery pattern to be sewn by embroidery sewing, reads out from the storage unit 103 the embroidery data (sewing data) corresponding to the selected embroidery pattern, and then loads the read-out embroidery data into the working area of the RAM 102 (block B1). Then, the CPU 101 sets program control data related to the embroidery data (sewing data) and loads the thus-set program control data into the working area of the RAM 102 (block B2). As noted above, the setting of the program control data may be done by user's manual operation via the operation panel 108 and the like, or by reading out the program control data preset and prestored in the storage unit 103 in association with the embroidery data (sewing data).

As a reference, example settings of the program control data are illustrated in FIG. 5. In FIG. 5, an example is illustrated where the embroidery data (sewing data) corresponding to one embroidery pattern include a plurality of pieces of operation mode information indicative of different sewing operation modes of five steps. More specifically, in the illustrated example of FIG. 5, types of factors defining the sewing operation mode of each of the steps are "STITCHING TECHNIQUE", "NIPPLE HEIGHT", "NIPPLE'S BOTTOM DEAD POINT", and "QUICK SHIFT PROCESS", and specific content of each of the factor types is illustrated in each of horizontal rows corresponding to the respective steps. In a vertical column labeled "STITCHING TECHNIQUE", sign "N" denotes "FLAT STITCHING", "Z1" denotes "ZIGZAG STITCHING PATTERN 1", "Z4" denotes "ZIGZAG STITCHING PATTERN 4", and "T" denotes "TAPE STITCHING". Each numerical value in a vertical column labeled "NIPPLE HEIGHT" denotes a height of the top dead point in the nipple stroke. Each numerical value in a vertical column labeled "NIPPLE'S BOTTOM DEAD POINT" denotes a height of the bottom dead point in the nipple stroke. Further, a vertical column labeled "QUICK SHIFT PROCESS" indicates presence/absence of information R instructing that the quick shift process should be executed at the boundary between the current step (namely, step immediately preceding the boundary) and the next step (namely, step succeeding the boundary). Thus, in each of the steps having the information R set therefor, the quick shift process is executed at the boundary between the current step (namely, step immediately preceding the boundary) and the next step (namely, step succeeding the boundary). Sign "–" in the "QUICK SHIFT PROCESS" column denotes that the step in question does not have the information R set therefor, namely, that the quick shift process should not be executed at the boundary between the current step (namely, step immediately preceding the boundary) and the next step (namely, step succeeding the boundary). The "QUICK SHIFT PROCESS" is a process that is controlled by the aforementioned quick shift process means. Executing the quick shift process means executing a necessary process for shifting to the next sewing operation mode while keeping the main shaft rotating, and not executing the quick shift process means executing the necessary process for shifting to the next sewing operation mode and/or executing a manual operation (arrangements change operation) after temporarily stopping the rotation of the main shaft.

Whether or not the quick shift process can be executed (namely, whether the quick shift process is executable or non-executable) at the boundary between the steps (namely, boundary between the different sewing operation modes) can be determined depending on a difference between the sewing operation modes (particularly, between the "stitching techniques") in the steps immediately preceding and succeeding the boundary. FIG. 6 is a table of examples of the determination as to whether or not the quick shift process can be executed made depending on the difference between the sewing operation modes (particularly, between the "stitching techniques"). In FIG. 6, a vertical column indicates types of "STITCHING TECHNIQUE" in the preceding step, and a horizontal row indicates types of "STITCHING TECHNIQUE" in the succeeding step. More specifically, in FIG. 6, sings "N", "T", "Z1", and "Z4" denote the same types of "stitching techniques" as noted above, and "Z2" denotes "zigzag stitching pattern 2", "Z3" denotes "zigzag stitching pattern 3", "Z5" denotes "zigzag stitching pattern 5", "Z6" denotes "zigzag stitching pattern 6", "C" denotes "rolled stitching", "H" denotes "pleat stitching", and "F" denotes "frill stitching". Further, signs "o" and "x" put at intersecting points between the individual stitching technique types indicated in the vertical column and the individual stitching technique types indicated in the horizontal row are signs denoting whether or not the quick shift process can be executed; that is, sign "o" denotes that the quick shift process can be executed, while sign "x" denotes that the quick shift process cannot be executed.

In general, the quick shift process can be executed in a case where there is no need to replace an attachment necessary for executing a particular stitching technique (such as a tape stitching guide section or a zigzag stitching guide section), change a position of the attachment, or the like. On the other hand, the quick shift process cannot be executed in a case where there is a need to replace an attachment, change the position of the attachment, or the like. In the present embodiment, it is necessary to change the position of the attachment, for example, when there is a need to selectively switch between using the zigzag stitching attachment (guide section) and not using the zigzag stitching attachment (guide section). In order to switch between using the zigzag stitching attachment (guide section) and not using the zigzag stitching attachment (guide section), it is necessary to move the guide member 25 to its operating position or retreat position, as noted above.

Note that the flat stitching N means normal embroidery stitching or sewing that does not sew the string-shaped material T2 to the sewing workpiece. In the flat stitching, although the guide member 25 is normally moved from the operating position to the retreat position, the sewing operation may also be executed with the guide member 25 staying at the operating position, depending on a sewing direction. For example, when the sewing direction in the flat stitching is not across the guide member 25, the flat stitching embroidery can be executed with the guide member 25 staying at the operating position. In such a case, the quick shift process can be applied. When the sewing operation is to be switched back to the zigzag stitching after having executed the flat stitching embroidery with the guide member 25 staying at the operating position, too, the quick shift process can be applied. Therefore, the quick shift process can be executed when the sewing operation is to be stitched from the flat stitching N to any one of zigzag stitching patterns Z1 to Z6 or from any one of zigzag stitching patterns Z1 to Z6 to the flat stitching N. When the sewing operation is to be stitched from any one of patterns Z1 to Z6 to another one of patterns Z1 to Z6, too, the quick shift process can be executed.

However, when the sewing operation is to be switched from the tape stitching T to any one of zigzag stitching patterns Z1 to Z6 or from any one of zigzag stitching patterns Z1 to Z6 to the tape stitching T, the quick shift process cannot be executed because there is a need to replace the stitching attachment with another one or to perform some necessary arrangements change operation, and thus the main shaft is temporarily stopped to enable the attachment replacement or the arrangements change operation. For example, when the sewing operation is to be switched from any one of zigzag stitching patterns Z1 to Z6 to the tape stitching T in a case where both the tape stitching guide section and the zigzag stitching guide section are provided as in the illustrated example, it is necessary to perform the arrangements change operation of moving the guide member to the retreat position to place the zigzag stitching attachment (guide section) in a non-usable state and pulling a distal end portion of the string-shaped material T1 out of the tape stitching guide section 12 to place the distal end portion of the string-shaped material T1 at the needle entry position. Therefore, in such a case, the quick shift process cannot be executed. Not only in a sewing machine where two different types of guide sections are provided as in the illustrated example but also in a sewing machine of a type where switching between the tape stitching guide section and the zigzag stitching guide section is made by replacing one attachment with another, the quick shift process cannot be executed when switching between the tape stitching and the zigzag stitching is to be made.

Referring back to FIG. 5, because the stitching technique is shifted from the flat stitching N to zigzag stitching pattern Z1 at a switch point from step 1 to step 2 (namely, at the boundary between step 1 and step 2), it is possible to set the quick shift process, and thus the information R instructing that the quick shift process should be executed can be set. Similarly, because the stitching technique is shifted from zigzag stitching pattern Z1 zigzag stitching pattern Z4 at a switch point from step 2 to step 3 (namely, at the boundary between step 2 and step 3), it is possible to set the quick shift process, and thus the information R instructing that the quick shift process should be executed is set. However, although the stitching technique is shifted to same zigzag stitching pattern Z4 (namely, zigzag stitching pattern Z4 remains unchanged) at a switch point from step 3 to step 4 (at the boundary between step 3 and step 4), the information R instructing that the quick shift process should be executed is not set, and thus the quick shift process is not executed here. Namely, in the illustrated example, it was set, based on a user's desire or request, that the quick shift process should not be executed at the boundary between step 3 and step 4. Namely, if it is desired to temporarily stop the rotation of the main shaft to perform some switching operation at the time of switching from step 3 to step 4, then such a setting may be made. In other words, even where the quick shift process can be executed theoretically according to the table of FIG. 6, it is possible to set the program control data in such a manner as to not execute the quick shift process because of a reason peculiar to the user. At a switch point from step 4 to step 5 (at the boundary between step 4 and step 5), because the stitching technique is shifted from zigzag stitching pattern Z4 to the tape stitching T, the quick shift process cannot be executed as illustrated in FIG. 6, and thus the information R instructing that the quick shift process should be executed, namely, instructing execution of the quick shift process is not set here.

Note that when the user sets program control data by operating the operation panel 108 and the like in the operation of block B2 of FIG. 4, the user may be enabled to appropriately set the information R, which instructs that the quick shift process should be executed, while visually referring to the table of examples of the determination as to whether or not the quick shift process can be executed as illustrated in FIG. 6. In an alternative, the table of examples of the determination as to whether or not the quick shift process can be executed as illustrated in FIG. 6 may be computerized to be prestored in a memory (such as the storage unit 103), and in the operation of block B2 of FIG. 4, the user may automatically refer to such computerized data (table) when setting program control data by operating the operation panel 108 and the like. For example, the inventive sewing machine may be configured in such a manner that when the user sets program control data by operating the operation panel 108 and the like in the operation of block B2 of FIG. 4 and if the user has erroneously performed an operation of setting the information R, which instructs execution of the quick shift process, at a position (namely, boundary marked by the x sign in FIG. 6) where the quick shift process cannot be executed, a determination is made, with reference to the table, that such a user's setting operation is invalid, to thereby prevent the information R instructing execution of the quick shift process from being set (stored) into the memory. Thus, even if the user has performed a setting operation such that the quick shift process should be executed at the switch point from step 4 to step 5 (at the boundary between step 4 and step 5), the information R instructing execution of the quick shift process is not actually set (stored) in the illustrated example of FIG. 5.

The explanation of FIG. 4 will be given further below. The CPU 101 sets the step number n of the sewing operation mode at an initial value of 1 in block B2. Then, the CPU 101 reads out from the working area of the RAM 102 the program control data related to first step 1 (n=1) and sets the sewing operation mode of the sewing machine in a state corresponding to the read-out program control data (block B4). In the illustrated example of FIG. 5, for instance, at step 1, the "STITCHING TECHNIQUE" is set at the flat stitching (N), the "NIPPLE HEIGHT" is set at a value of "6", the "NIPPLE'S BOTTOM DEAD POINT" is set at a value of "0.5", and the information R instructing execution of the quick shift process at the time of switching to the next step is set. Note that at appropriate timing from block B1 through block B4, e.g., at the end of block B4, a rotation start switch of the main shaft 1 may be turned on by a user's operation so as to start the sewing operation.

Then, the CPU 101 reads out from the working area of the RAM 102 the embroidery data (sewing data) related to step n (initially, n=1) sequentially stitch by stitch and performs the sewing operation by driving the embroidery frame in the X and Y directions and moving the needle bar 2 in the up-down direction (block B5). Note that because the "stitching technique" is the flat stitching (N) in step 1 in the illustrated example of FIG. 5, the zigzag swinging motor 32 is not driven and thus the normal embroidery stitching is performed in this step.

During the sewing operation for step n (initially, n=1), the CPU 101 pre-reads the step switch code (or color change code) included in the control codes of this step n and determines whether or not step switching timing (namely, the end of step n) arrives after a predetermined number of stitches (block B6). If the step switching timing (namely, the end of step n) does not arrive yet as determined in block B6 (NO determination in block B6), the CPU 101 reverts to block B5 to continue the sewing operation for step n. If the step switching timing (namely, the end of step n) arrives after the predetermined number of stitches as determined in block B6 (YES determination in block B6), the CPU 101 further determines whether or not the information R instructing execution of the quick shift process is set in the program control data, namely, whether or not the program control data have the information R set therein (block B7).

If the program control data do not have the information R instructing execution of the quick shift process set therein, a NO determination is made in block B7, and so the processing flow branches in order to perform an operation for preparing for the succeeding or next step after temporarily stopping the rotation of the main shaft 1 (block B8). More specifically, in block B8, the CPU 101 performs the remaining sewing operation for the predetermined number of stitches until the actual timing of the step switch code (color change code) arrives. Once the actual timing of the step switch code (color change code) arrives (namely, once the sewing operation for step n ends), the CPU 101 temporarily stops the rotation of the main shaft 1 and then prepares for the next step (n+1). Preparations for the next step (n+1) made here include reading out from the RAM 102 the program control data related to the next step (n+1), and setting the sewing operation mode of the sewing machine in a state corresponding to the read-out program control data (operation similar to that of block B4). The preparations for the next step (n+1) further include automatically and/or manually replacing the current attachment with another attachment necessary for executing a stitching technique set for the next step (n+1) (such as the tape switching guide section or the zigzag stitching guide section) and changing the position of any of the sewing machine components including the attachment (for example, returning such a sewing machine component to its retreat position or setting the sewing machine component in its operating position).

If the program control data have the information R instructing execution of the quick shift process set therein, a YES determination is made in block B7, the processing flow branches in order to shift to operations (of blocks B9, B10, and B11) for the quick shift process. The quick shift process executable in the present embodiment has two variations: the first variation where there is a need to make replacement or positional change of any of the sewing machine components for the next step (n+1); and the second variation where there is no such need. Thus, in block B9, the CPU 101 determines in which of the two variations the quick shift process should be executed. The information R included in the program control data may include data instructing in which of the two variations the quick shift process should be executed, and in block B9, the CPU 101 may determine, on the basis of such variation-instructing data, in which of the variations the quick shift process should be executed. Alternatively, in block B9, the CPU 101 may compare the program control data of the current step (preceding step) and the program control data of the next step (succeeding step) and determine, on the basis of results of the comparison between the two, in which of the variations the quick shift process should be executed.

If there is no need to make replacement or positional change of any of the sewing machine components (NO determination in block B9), the processing flow branches in order to perform an operation for preparing for the next step while keeping the main shaft 1 rotating (block B10). More specifically, in block B10, the CPU 101 performs the remaining sewing operation for the predetermined number of stitches until the actual timing of the step switch code (color change code) arrives, and once the actual timing of the step switch code (color change code) arrives (namely, once the sewing operation for step n ends), the CPU 101 prepares for the next step (n+1) while keeping the rotation of the main shaft 1. Preparations for the next step (n+1) made here include reading out from the working area of the RAM 102 the program control data related to the next step (n+1) and setting the sewing operation mode of the sewing machine in a state corresponding to the read-out program control data (operation similar to that of block B4).

Figure 7:
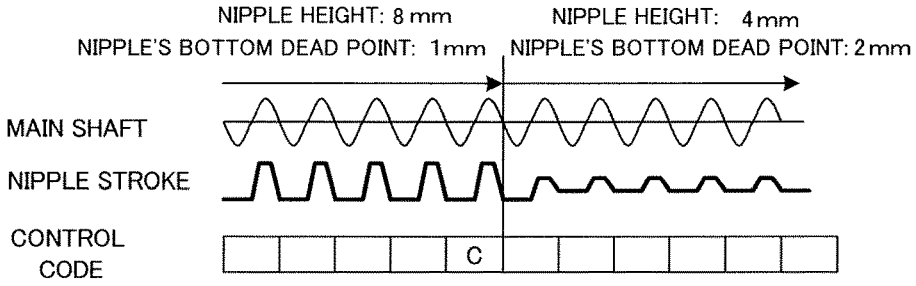
FIG. 7 is a timing chart illustrating examples of a rotating state of a main shaft and the like before and after sewing operation mode switching.

The case where there is no need to make replacement or positional change of any of the sewing machine components is, for example, one where the respective sewing operation modes of the preceding and succeeding steps differ from each other in that the height and/or bottom dead point of the stroke of the presser foot (nipple) 10 differ between the two steps without the stitching technique differing or varying between the two steps. FIG. 7 illustrates examples of the rotating state of the main shaft 1 and the like before and after the step switching in such a case. In FIG. 7, the horizontal axis represents the passage of time, while the vertical axis represents respective states of three kinds of control elements, "MAIN SHAFT", "NIPPLE STROKE", and "CONTROL CODE". In FIG. 7, the section of "MAIN SHAFT" illustrates in a waveform the rotating state of the main shaft 1, and the section of "NIPPLE STROKE" illustrates in a waveform the movement of the presser foot (nipple) 10. More specifically, in the illustrated example, the nipple height and the nipple's bottom dead point in the preceding step are 8 mm and 1 mm, respectively, and the nipple height and the nipple's bottom dead point in the succeeding step are 4 mm and 2 mm, respectively. Reference character C in the section of "CONTROL CODE" indicates timing at which the step switch code (color change code) actually arrives. In the illustrated example of FIG. 7, as clearly seen from the figure, the rotation of the main shaft 1 is kept at the time of switching between the steps.

Figure 8:
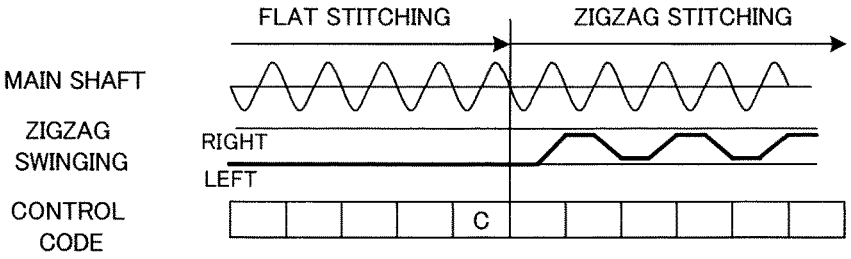
FIG. 8 is a timing chart illustrating other examples of the rotating state of the main shaft and the like before and after sewing operation mode switching.

Further, another example of the case where there is no need to make replacement or positional change of any of the sewing machine components is one where the stitching technique used for the string-shaped material is switched from the flat stitching to the zigzag stitching with the guide member 25 kept at the operating position. FIG. 8 illustrates examples of the rotating state of the main shaft 1 and the like before and after the step switching in such a case. In FIG. 8, the horizontal axis represents the passage of time, while the vertical axis represents respective states of three kinds of control elements, "MAIN SHAFT", "ZIGZAG SWINGING", and "CONTROL CODE". In FIG. 8, the section of "ZIGZAG SWINGING" indicates a state of the zigzag swinging operation performed by the zigzag swinging mechanism. Namely, in the illustrated example of FIG. 8, the zigzag swinging is not executed in the preceding step, and the zigzag swinging is started at stitching timing following the timing C at which the step switch code (color change code) actually arrives. In the illustrated example of FIG. 8, too, the rotation of the main shaft 1 is kept at the time of switching between the steps.

Referring back to FIG. 4, when there is a need to make replacement or positional change of any of the sewing machine components, a YES determination is made in block B9, and so the processing flow branches to block B11. In block B11, the CPU 101 executes a needle bar jump and/or number-of-rotation reduction control of the main shaft 1 and performs an operation for preparing for the next step while keeping the main shaft 1 rotating. More specifically, the CPU 101 performs the remaining sewing operation for the predetermined number of stitches until the actual timing of the step switch code (color change code) arrives. Once the actual timing of the step switch code (color change code) arrives (namely, once the sewing operation for step n ends), the CPU 101 performs a preparation operation for the next step (n+1) including the needle bar jump and/or number-of-rotation reduction control of the main shaft 1 while keeping the main shaft 1 rotating. The preparation operation performed here for the next step (n+1) includes: executing, in accordance with the sewing operation mode of the next step (n+1), any one of (1) needle bar jump, (2) number-of-rotation reduction control of the main shaft 1, and (3) both the needle bar jump and the number-of-rotation reduction control of the main shaft 1; and, during that time, making the replacement or positional change of any of the sewing machine components automatically and/or manually, reading out from the working area of the RAM 102 the program control data related to the next step (n+1), and setting the sewing operation mode of the sewing machine in a state corresponding to the read-out program control data (operation similar to that of block B4).

Further, the case where there is a need to make replacement or positional change of any of the sewing machine components is, for example, one where although the stitching technique used for the string-shaped material does not differ between the preceding and succeeding steps, directions of the string-shape material bobbins 11 and 29 (namely, angle of the rotation member 13) vary by 90 degrees between the preceding and succeeding steps. In such a case, because the bobbins 11 and 29 cannot be rotated by 90 degrees within a single stitch operation time if the main shaft 1 is being rotated with a normal number of rotations (such as 1,000 rpm), a rotation speed of the main shaft 1 is automatically reduced down to a particular speed such that the bobbins 11 and 29 can be rotated by 90 degrees within the single stitch operation time. Namely, the speed reduction control of the main shaft 1 is started at timing that immediately precedes the actual timing C of the step switch code (color change code) by the aforementioned number of stitches so that necessary speed reduction of the main shaft 1 is achieved at the actual timing C of the step switch code (color change code) and thus the bobbins 11 and 29 are rotated by 90 degrees within the single stitch operation time at that timing C. The sewing operation for the next step (n+1) is started at timing that immediately succeeds the actual timing C of the step switch code (color change code), at which time the number-of-rotation control is automatically performed in such a manner that the rotation of the main shaft 1 is accelerated for a time corresponding to a first appropriate number of stitches and that after the normal number of rotations (such as 1,000 rpm) is reached, the main shaft 1 is rotated at a constant speed.

Figure 9:
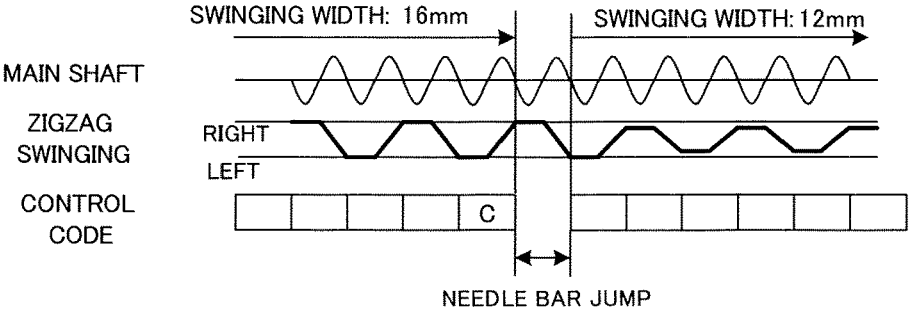
FIG. 9 is a timing chart illustrating still other examples of the rotating state of the main shaft and the like before and after sewing operation mode switching.

Another example of the case where there is a need to make replacement or positional change of any of the sewing machine components is one where although the stitching technique of both of the preceding and succeeding steps is the same zigzag stitching technique but the preceding and succeeding steps differ from each other in terms of a stroke phase of the zigzag swinging. As a stroke start phase of the zigzag swinging, there are two types, rightward swinging start phase and leftward swinging start phase. In the rightward swinging start phase, the guide lever is caused to swing from the left to the right, then swing from the right back to the left, and thereafter repeat such swinging movement. In the leftward swinging start phase, the guide lever is caused to swing from the right to the left, then swing from the left back to the right, and thereafter repeat such swinging movement. In some case, the stroke phase of the zigzag swinging in the preceding step does not match the zigzag swinging stroke start phase in the succeeding step. In such a case, at the time of switching between the steps, the CPU 101 performs control such that the sewing operation for the next step (n+1) starts with the preset rightward or leftward swinging, by executing a needle bar jump while keeping the main shaft 1 rotating and then causing the guide lever 22 to swing without causing the sewing operation during the needle bat jump. FIG. 9 illustrates examples of the rotating state of the main shaft 1 and the like before and after the step switching in such a case. In FIG. 9, the horizontal axis represents the passage of time, while the vertical axis represents respective states of three kinds of control elements, "MAIN SHAFT", "ZIGZAG SWINGING", and "CONTROL CODE". The section of "ZIGZAG SWINGING" in FIG. 9 indicates a state of the zigzag swinging operation performed by the zigzag swinging mechanism. In the illustrated example of FIG. 9, the zigzag swinging is executed with a swinging width of 16 mm in the preceding step, a step switch code (color change code) actually arrives at the last stitching timing C of the preceding step, and at that time, the stroke phase of the zigzag swinging in the preceding step ends in the rightward swinging. By contrast, because the stroke start phase of the succeeding step (n+1) is set at the rightward swinging start, the stroke start phase of the succeeding step (n+1) does not match the stroke phase of the preceding step ending in the rightward swinging. Thus, while keeping the main shaft 1 rotating, the CPU 101 executes the needle bar jump at timing that immediately succeeds the timing C at which the step switch code (color change code) actually arrives, thereby causing the guide lever 22 to make one swinging or pivoting movement leftward idly, namely, with no sewing operation performed. Thus, because the guide lever 22 is caused to swing rightward at the succeeding timing, the sewing operation for the succeeding step (n+1) can be started with rightward swinging as previously set.

Still another example of the case where there is a need to make replacement or positional change of any of the sewing machine components is one where the difference between the ways of sewing (sewing operation modes) of the preceding and succeeding steps is that the height or bottom dead point of the stroke of the presser foot (nipple) 10 extremely differs between the preceding and succeeding steps although the stitching technique does not vary between the preceding and succeeding steps. In such a case, the CPU 101 performs control for, while keeping the main shaft 1 rotating, executing the needle bar jump at timing that immediately succeeds the timing C at which the step switch code (color change code) actually arrives and thereby adjusting the height position of the presser foot (nipple) 10 to a stroke height or bottom dead point preset for the succeeding step (n+1).

Referring back to FIG. 4, the CPU 101 increments the number of step n by one in block B12. In next block B13, the CPU 101 determines whether or not the sewing operation has ended for all the steps related to the currently sewn embroidery pattern. If the sewing operation has not yet ended for all the steps as determined in block B13, the processing flow reverts to aforementioned block B5, where the sewing operation is performed for the current step n in a manner similar to the above-described.

Next, a description will be made about a portion of the processing flow of FIG. 4 followed when switching is made from step 1 to step 2 in the example of FIG. 5. When it is determined, during the sewing operation for step 1, that step switching timing (namely, the end of step 1) arrives after a predetermined number of stitches, the processing flow branches from the YES determination of block B6 to block B7. Because the information R instructing that the quick shift process should be executed at the time of switching from step 1 to step 2 is set in the example of FIG. 5, the processing flow branches from the YES determination of block B7 to block B9. Because the stitching technique is switched from the flat stitching N to zigzag stitching pattern Z1 at the time of switching from step 1 to step 2 in the example of FIG. 5, it is determined that there is no need to make replacement or positional change of any of the sewing machine components, and thus the processing flow branches from the NO determination of block B9 to block B10. In block B10, the CPU 101 makes preparations for next step 2 while keeping the main shaft 1 rotating. As a specific example, while keeping the main shaft 1 rotating, the CPU 101 performs control such that driving of the zigzag swinging motor 32 is started at timing immediately succeeding the actual timing C of the step switch code (color change code) (namely, at timing at which the sewing operation for step 1 ends) and so the zigzag swinging of the guide lever 22 is started, as illustrated in FIG. 8.

Further, a description will be made about a portion of the processing flow of FIG. 4 followed when switching is made from step 2 to step 3 in the example of FIG. 5. When it is determined, during the sewing operation for step 2, that step switching timing (namely, the end of step 2) arrives after a predetermined number of stitches, the processing flow branches from the YES determination of block B6 to block B7. Because the information R instructing that the quick shift process should be executed at the time of the switching from step 2 to step 3 is set in the example of FIG. 5, the processing flow branches from the YES determination of block B7 to block B9. Because the stitching technique is switched from zigzag stitching pattern Z1 to zigzag stitching pattern Z4 at the time of the switching from step 2 to step 3 in the example of FIG. 5, it is determined that there is no need to make replacement or positional change of any of the sewing machine components, and so the processing flow branches from the NO determination of block B9 to block B10. In block B10, the CPU 101 makes preparations for next step 3 while keeping the main shaft 1 rotating. As a specific example, while keeping the main shaft 1 rotating, the CPU 101 performs control such that the nipple stroke is switch to a state preset for next step 3 at timing immediately succeeding the actual timing C of the step switch code (color change code) (namely, timing at which the sewing operation for step 2 ends), as illustrated in FIG. 7.

Further, a description will be made about a portion of the processing flow of FIG. 4 followed when switching is made from step 4 to step 5 in the example of FIG. 5. When it is determined, during the sewing operation for step 4, that step switching timing (namely, the end of step 4) arrives after a predetermined number of stitches, the processing flow branches from the YES determination of block B6 to block B7. Because the information R instructing that the quick shift process should be executed at the time of the switching from step 4 to step 5 is not set in the example of FIG. 5, the processing flow branches from the NO determination of block B7 to block B8. Namely, in the example of FIG. 5, because the stitching technique is switched from zigzag stitching pattern Z4 to the tape stitching T at the time of the switching from step 4 to step 5, it is set that there is a need to make replacement or positional change of any of the sewing machine components, and so the quick shift process cannot be executed. In block B8, the CPU 101 temporarily stops the rotation of the main shaft 1 and makes preparations for next step 5. More specifically, the remaining sewing operation for the predetermined number of stitches is performed in accordance with zigzag stitching pattern Z4 until the actual timing C of the step switch code (color change code) arrives. Then, once the actual timing C of the step switch code (color change code) arrives (namely, once the sewing operation for current step n ends), the CPU 101 temporarily stops the rotation of the main shaft 1 and then makes preparations for next step 5. The preparations for next step 5 are the same as set forth above. Particularly in this specific example, operations of moving the guide member 25 to the retreat position and pulling the distal end portion of the string-shaped material T1 out of the tape stitching guide section 12 to place the distal end portion of the string-shaped material T1 at the needle entry position are performed by a human operator. After that, the CPU 101 restarts the rotation of the main shaft 1 and starts the sewing operation for step 5 (namely, performs the sewing of the string-shaped material T1 with the tape stitching technique T).

The present embodiment of the invention has been described above in connection with the case where the information R instructing execution of the quick shift process is set as the program control data. However, the inventive sewing machine is not so limited. For example, the quick shift process means may be provided with a table similar to the one illustrated in FIG. 6, and when it is to be determined whether or not the quick shift process should be executed (for example, in block B7 of FIG. 4), such a determination may be made with reference to the aforementioned table provided in the quick shift process means.

From the above-described embodiment, it can be understood that the invention related to the controlling device 100 applied to a sewing machine is disclosed here. Here, the sewing machine to which is applied the controlling device 100 is configured to sew the string-shaped material (T1 or T2) to the sewing workpiece (W) on the basis of the pre-programmed sewing data, and the controlling device 100 is configured to control the sewing operation of the sewing machine on the basis of the pre-programmed sewing data. Particularly, the controlling device 100 includes: sewing data supply means (storage unit 103, CPU 101, processing blocks B1 to B4, and the like) that supplies the sewing data having pieces of operation mode information, indicative of different sewing operation modes, mixed therein; and quick shift process means (CPU 101, processing blocks B6 to B11, and the like) that controls, at the boundary between the different sewing operation modes and depending on a difference between the sewing operation modes immediately preceding and succeeding the boundary, whether to execute the process for shifting to the next sewing operation mode while keeping the main shaft of the sewing machine rotating or to execute the process for shifting to the next sewing operation mode after temporarily stopping the rotation of the main shaft.

Further, from the above-described embodiment, it can be understood that the sewing machine provided with the aforementioned controlling device 100 is disclosed. This sewing machine includes: the needle bar 2 having the sewing needle 3 attached thereto and drivable to reciprocatingly move up and down in response to the rotation of the main shaft 1; the rotation cylinder (namely, rotation member) 13 provided around the outer periphery of the needle bar 2 and rotatable about the axis of the needle bar 2; the guide 12 or the guide member 25 (namely, guide section) movable with the rotation cylinder 13 for guiding the string-shaped material T1 or T2 to the sewing position; and the aforementioned controlling device 100. The sewing machine sews the string-shaped material T1 or T2, guided by the guide section (12 or 25) in response to the reciprocating movement of the needle bar 2, to the sewing workpiece W in accordance with the sewing data, and the sewing machine keeps the main shaft 1 rotating or temporarily stops the rotation of the main shaft 1 in accordance with the control by the quick shift process means (CPU 101, processing blocks B6 to B11, and the like).

Further, as may also be clear from the above-described embodiment, the present invention can be implemented also as a controlling method for the sewing machine. Namely, the sewing machine is configured to sew the string-shaped material to the sewing workpiece on the basis of the pre-programmed sewing data, and the controlling method for the sewing machine includes: a first step of performing, on the basis of the sewing data, sewing of the string-shaped material T1 or T2 to the sewing workpiece W in a first sewing operation mode; a second step of performing, on the basis of the sewing data, the sewing of the string-shaped material T1 or T2 to the sewing workpiece W in a second sewing operation mode after the first sewing operation mode; and a third step of controlling, at a boundary between the first step and the second step and depending on a difference between the first and second sewing operation modes, whether to execute the process for shifting to the second sewing operation mode while keeping the main shaft 1 of the sewing machine rotating or to execute the process for shifting to the second sewing operation mode after temporarily stopping the rotation of the main shaft. Furthermore, the aforementioned sewing-machine controlling method can be implemented as a software program to be executed by a computer or a processor, but also as a non-volatile storage medium having such a program stored therein.

The invention claimed is:

1. A controlling device for a sewing machine, the sewing machine being configured to sew a string-shaped material to a workpiece based on pre-programmed sewing data, the controlling device being configured to control a sewing operation of the sewing machine based on the sewing data, the controlling device comprising:

a sewing data supply device that supplies the sewing data having pieces of operation mode information, indicative of different sewing operation modes, mixed therein; and a processor configured to control, at a boundary between the different sewing operation modes and depending on a difference between the sewing operation modes immediately preceding and succeeding the boundary, whether to execute a process for shifting to the succeeding sewing operation mode while keeping a main shaft of the sewing machine rotating or to execute the process for shifting to the succeeding sewing operation mode after temporarily stopping the rotation of the main shaft.

2. The controlling device for a sewing machine as claimed in claim 1, wherein the sewing data supplied by the sewing data supply device includes a mode-switching control code indicative of the boundary between the different sewing operation modes, the processor controls, depending on a difference between the sewing operation modes immediately preceding and succeeding the mode-switching control code and at the boundary between the sewing operation modes, whether to execute the process for shifting to the succeeding sewing operation mode while keeping the main shaft rotating or to execute the process for shifting to the succeeding sewing operation mode after temporarily stopping the rotation of the main shaft.

3. The controlling device for a sewing machine as claimed in claim 1, wherein the processor is configured to set, at each boundary between the different sewing operation modes, information instructing whether or not to shift to the succeeding sewing operation mode while keeping the main shaft rotating, and the processor controls, based on the information, whether to execute the process for shifting to the succeeding sewing operation mode while keeping the main shaft rotating or to execute the process for shifting to the succeeding sewing operation mode after temporarily stopping rotation of the main shaft.

4. The controlling device for a sewing machine as claimed in claim 3, wherein the processor is configured to set the information in response to a user's operation and store the information set in response to the user's operation.

5. The controlling device for a sewing machine as claimed in claim 1, wherein the sewing machine includes a needle bar jump mechanism that executes a needle bar jump for temporarily stopping reciprocating movement of a needle bar while keeping the main shaft rotating, and when executing the process for shifting to the succeeding sewing operation mode while keeping the main shat rotating, the processor performs control such that the needle bar jump mechanism executes the needle bar jump while keeping the rotation of the main shaft.

6. The controlling device for a sewing machine as claimed in claim 1, wherein when executing the process for shifting to the succeeding sewing operation mode while keeping the main shaft rotating, the processor controls whether to rotate the main shaft without reducing a rotating speed of the main shaft or to rotate the main shaft at a reduced speed.

7. The controlling device for a sewing machine as claimed in claim 1, wherein the different sewing operation modes are modes in which different string-shaped material stitching techniques, including a zigzag stitching technique and a tape stitching technique, are used.

8. The controlling device for a sewing machine as claimed in claim 1, wherein the different sewing operation modes are modes that differ from each other in terms of a stitching pattern used in zigzag-stitching the string-shaped material.

9. A controlling method for a sewing machine, the sewing machine being configured to sew a string-shaped material to a workpiece based on pre-programmed sewing data, the controlling method comprising:

a first step of performing, based on the sewing data, sewing of the string-shaped material to the workpiece in a first sewing operation mode;

a second step of performing, based on the sewing data, the sewing of the string-shaped material to the workpiece in a second sewing operation mode after the first step; and a third step of controlling, at a boundary between the first step and the second step and depending on a difference between the first and second sewing operation modes, whether to execute a process for shifting to the second sewing operation mode while keeping a main shaft of the sewing machine rotating or to execute the process for shifting to the second sewing operation mode after temporarily stopping the rotation of the main shaft.

10. A non-transitory computer readable storage medium storing a program for causing a processor, included in a controlling device for a sewing machine, to execute the controlling method set forth in claim 9.

11. A sewing machine comprising:

a needle bar having a sewing needle attached thereto and drivable to reciprocatingly move in response to rotation of a main shaft;

a rotation member provided around an outer periphery of the needle bar and rotatable about an axis of the needle bar;

a guide section movable in response to rotation of the rotation member for guiding a string-shaped material to a sewing position; and a controlling device being configured to control a sewing operation of the sewing machine based on sewing data, wherein the controlling device comprises:

a sewing data supply device that supplies the sewing data having pieces of operation mode information, indicative of different sewing operation modes, mixed therein; and a processor configured to control, at a boundary between the different sewing operation modes and depending on a difference between the sewing operation modes immediately preceding and succeeding the boundary, whether to execute a process for shifting to the succeeding sewing operation mode while keeping a main shaft of the sewing machine rotating or to execute the process for shifting to the succeeding sewing operation mode after temporarily stopping the rotation of the main shaft.

* * * * *